US005180511A

United States Patent [19]

Harrison

[11] Patent Number: 5,180,511

[45] Date of Patent: Jan. 19, 1993

[54] FLOTATION AID AND PROCESS FOR REMOVAL OF IMPURITIES FROM SILICATE MINERALS

[75] Inventor: John M. M. Harrison, Macon, Ga.

[73] Assignee: J.M. Huber Corporation, Rumson, N.J.

[21] Appl. No.: 718,055

[22] Filed: Jun. 20, 1991

Related U.S. Application Data

[62] Division of Ser. No. 407,425, Sep. 14, 1989, Pat. No. 5,037,534.

[51] Int. Cl.[5] ..... B03D 1/018; B03D 1/02

[52] U.S. Cl. ..... 252/61; 209/166; 209/167

[58] Field of Search ..... 209/166, 167; 252/61, 252/174.25, 352, 133; 423/118, 119, 600

[56] References Cited

U.S. PATENT DOCUMENTS

| | | | |
|---|---|---|---|
| 1,953,431 | 4/1934 | Patek | 207/167 |
| 2,571,690 | 10/1951 | Dobbelmann | 252/133 |
| 3,081,190 | 3/1963 | Johnson | 252/133 |
| 3,255,117 | 6/1966 | Knapp | 252/99 |
| 3,450,257 | 6/1969 | Cundy | 209/166 |
| 3,928,195 | 12/1975 | Hoeltgen | 210/724 |
| 3,939,100 | 2/1976 | Hau | 252/133 |
| 3,976,588 | 8/1976 | McLaughlin | 252/133 |
| 4,166,039 | 8/1979 | Wise | 252/133 |
| 4,209,396 | 6/1980 | White | 210/705 |
| 4,289,641 | 9/1981 | Hooper | 252/97 |
| 4,299,739 | 11/1981 | Esposito | 252/133 |
| 4,326,971 | 4/1982 | Wixon | 252/133 |
| 4,332,693 | 6/1982 | Piepho | 210/767 |
| 4,415,467 | 11/1983 | Piepho | 210/698 |
| 4,448,584 | 5/1984 | Masologites et al. | 209/166 |
| 5,037,534 | 8/1991 | Harrison | 209/167 |

FOREIGN PATENT DOCUMENTS

| | | | |
|---|---|---|---|
| 770660 | 10/1967 | Canada | 209/166 |
| 22953 | 2/1985 | Japan | 209/166 |

*Primary Examiner*—Stanley S. Silverman
*Assistant Examiner*—Thomas M. Lithgow
*Attorney, Agent, or Firm*—Harold H. Flanders; Alec H. Horn; Robert L. Price

[57] ABSTRACT

A novel flotation aid for use in the flotation removal of contaminates or impurities from mineral slurries. The flotation aid is an alkali aluminate compound. The flotation aid may be incorporated into a flotation reagent system that includes a chemical collector.

12 Claims, No Drawings

FLOTATION AID AND PROCESS FOR REMOVAL OF IMPURITIES FROM SILICATE MINERALS

This is a division of application Ser. No. 07/407,425, filed Sep. 14, 1989, now U.S. Pat. No. 5,037,534.

TECHNICAL FIELD

This invention relates to an improved froth flotation process for removing colored impurities from clay materials and more particularly relates to a novel flotation aid for use in conjunction with a chemical collector.

BACKGROUND ART

Crude clay materials, particularly kaolin clays, as mined, contain various forms of discoloring elements, two major impurities being titaniferous compounds, usually in the form of anatase ($TiO_2$) and iron oxides. In order to improve the physical properties of these clays and make these clays more acceptable for use in the paper industry, the impurities must be substantially removed by appropriate techniques.

The production of high brightness clays requires removal of discoloring impurities from the clays. Removal of impurities usually includes two processing steps. In the first step, a significant portion of the impurities, mainly anatase is removed by employing one or more physical separation techniques, such as high gradient magnetic separation (HGMS), froth flotation and selective flocculation. In the second step the remaining impurities, mainly iron oxides, are removed by chemical leaching.

Of the known physical separation techniques, one of the most efficient commercially-practiced beneficiation techniques for improving the brightness and appearance of sedimentary clays, particularly kaolin clays, is removal of iron-stained antase particles by froth flotation.

Froth flotation processes for removal of anatase from kaolins involve the addition of a class of chemical reagents, commonly called "collectors". These collector reagents are surfactants, i.e., molecular entities of a Janus character with one end of the molecule having a polar functional group and the other end, a non-polar functionality. Incorporation of suitable collector reagents into kaolin slurries along with concurrent regulation of the activities of accessory chemical species present in the aqueous phase of the slurry, will result in the selective adsorption of the polar portion of the collector molecule onto the surface of an anatase particle. Upon adsorption, the non-polar portion of the adsorbed collector species will be exposed to the aqueous portion of the slurry and cause the anatase particles to have a hydrophobic character. In this state, the anatase particles can attach to a rising stream of air bubbles, as generated in a froth flotation cell, and thereby be removed from the kaolin slurry.

The more commonly used collector reagents for flotation of anatase from kaolin slurries are aliphatic fatty acids such as oleic acid (cis-9-Octadecenoic acid). An example of a flotation process employing oleic acid for flotation of anatase from kaolin slurries may be found in U.S. Pat. No. 3,450,257 to E.K. Cundy.

The present invention provides a method for improved froth flotation removal of contaminates by use of a novel flotation aid that works in conjunction with conventional collection reagents to produce mineral products, such as clays, which have significantly less contaminates than those processed by conventional flotation processes.

DISCLOSURE OF THE INVENTION

It is according one object of the present invention to provide for a novel flotation aid that enables improved flotation removal of contaminates from minerals.

It is another object of the present invention to provide for a unique flotation reagent system for use in a flotation process which reagent system includes a novel flotation aid in conjunction with a chemical collector.

A further object of the present invention is to provide a method for the flotation removal of contaminates from minerals which utilizes a novel flotation aid in addition to a chemical collector.

A still further object of the present invention is to provide mineral products which have been purified by a flotation process which utilizes a novel flotation aid in addition to a chemical collector.

According to the present invention there is provided a novel flotation aid that may be utilized in a flotation process in conjunction with a chemical collector to thereby produce a mineral product that has a significantly low concentration of undesirable contaminates or impurities.

The present invention further provides for a flotation process for removing contaminates from minerals which utilizes the novel flotation aid.

Additionally, the present invention also provides for mineral products, including clays, which have been purified by a flotation process which utilizes the novel flotation aid.

BEST MODE FOR CARRYING OUT THE INVENTION

The present invention is directed to a flotation aid which has been found to improve the efficiency of flotation removal of contaminates or impurities from minerals such as silicates, clays, oxide minerals and the like. Preferably, the flotation aid comprises sodium aluminate. However, it has been discovered that an equally effective flotation aid can include other alkali aluminate compounds which can be produced by substituting potassium, lithium, ammonium and other alkali metal cations for the sodium.

During a flotation process the flotation aid is added to a mineral slurry during a pre-conditioning procedure, as described in detail below. To insure maximum effectiveness, the pH of the slurry during the pre-conditioning procedure is preferably maintained at 4.0 or higher, and more preferably above 7.0. In one embodiment the pH was maintained between about 8.0 and about 9.0 during the preconditioning.

The pH of the slurry is adjusted during the pre-conditioning by addition of caustic soda. In this regard, it was discovered that the combination of caustic soda together with the alkali aluminate compound increased the overall efficiency of the flotation process.

Following pre-conditioning, a suitable chemical collector is added to the slurry and the slurry is subjected to a conventional conditioning process wherein the slurry is subjected to sufficient mixing to ensure that the chemical collector contacts and react with the contaminates or impurities which are to be removed. During this second conditioning step any suitable chemical collector can be utilized, including those with ionic or neutral functional groups which can attach to undesirable contaminates or impurities. In a preferred embodiment oleic acid was utilized as the chemical collector for removing titaniferious and iron oxide impurities.

Following the second conditioning step, the slurry is subjected to a flotation process, such as froth flotation in which the undesirable contaminates or impurities are removed.

Analysis of the mineral slurries which have been subjected to the flotation process of the present invention have been demonstrated to have lower contaminate concentrations than those subjected to similar flotation processes without the addition of an alkali aluminate compound. Although the mechanics by which the alkali aluminate compound aids in removing impurities is not fully understood, it is believed that the alkali aluminate compound functions as a depressant for the mineral slurry.

In addition to the flotation aid, the present invention is also directed to a flotation reagent system that includes the alkali aluminate compound in combination with a chemical collector. This flotation reagent system can be employed in various flotation processes such as froth dissolved air, ionic, solvent extraction and the like.

Besides the flotation aid and the flotation reagent system, the present invention further is directed to mineral materials which have been treated by the a flotation process that utilizes an alkali aluminate as a flotation aid. These resulting mineral materials which include silicate minerals, oxide minerals and particularly clay minerals have lower contaminate concentrations that conventionally processed minerals and demonstrate improved properties including higher brightness and lower yellowness indexes.

Although the present invention is directed to reagents and processes for purifying silicate minerals, oxide minerals, clay minerals and the like, the present invention is believed to be particularly applicable to the clay industry in which there is a great need for highly purified clays In this regard, the present invention has been found to be particularly applicable to purifying clays, and more particularly kaolin clays. Such kaolin clays include those characterized as gray, cream, white, East Georgia, Middle Georgia, hard, soft, coarse, fine, whole fraction, fine fraction, cretaceous, tertiary and the like.

As set forth above, the preferred flotation procedure utilized in the present invention involves preparing a mineral slurry, pre-conditioning the slurry by adding a flotation aid thereto, conditioning the slurry by adding a suitable collector thereto and subjecting the slurry to a flotation process.

The following general procedure illustrates the manner by which the flotation process is preformed in a preferred, exemplary embodiment. For illustrative purposes, this procedure utilizes specific materials which the present invention is not to be considered as strictly limited to.

The mineral to be purified must first be made into a slurry. A measured amount of a mineral, for example clay is added to a blunger tank containing measured amounts of water and dispersants. In a preferred embodiment, when utilizing clay, "N" brand sodium silicate and soda ash were added to aid in dispersing the clay. The clay was blunged with the water and dispersants for a suitable time, e.g. 15 minutes in a high speed mixer to form the slurry dispersion. After blunging, the clay was degritted and the solids content of the clay was appropriately adjusted by addition of water.

Following the slurry preparation, the slurry was preconditioned by the addition of an alkali aluminate compound followed by high speed mixing. In an exemplary embodiment wherein the mineral slurry was a clay suspension, sodium aluminate was added to the slurry and the resulting mixture was subjected to high speed mixing. During the pre-conditioning step, the pH of the slurry was maintained at or above 4.0 and preferable between about 8.0 and 9.0.

Following pre-conditioning, the slurry was subjected to a conventional flotation conditioning procedure in which a chemical collector was added to the slurry and the resulting mixture was subjected to high speed mixing. In the above exemplary embodiment wherein the mineral slurry was a clay, oleic acid was utilized as the chemical collector. During the conditioning procedure, the pH of the slurry mixture was maintained at or above 4.0 and preferable between about 8.0 and 9.0. The pH of the slurry was adjusted during conditioning by adding a suitable amount of caustic soda.

Following conditioning, the slurry was subjected to a flotation process. In the above exemplary embodiment wherein the mineral slurry was a clay and oleic acid was added as the chemical collector, the flotation procedure was conducted in a flotation machine in which air flow within the flotation machine caused the contaminates or impurities to "float" out of the slurry.

The following examples are presented to illustrate the invention which is not to be considered as being limited thereto. In the examples and throughout the specific components are referred to by weight unless otherwise indicated.

The following procedures utilized for removing contaminates or impurities from a mineral compound and for evaluating the products were utilized in each of the following examples.

Lump crude clay was taken from a commercial plant mill's inventory bin. The samples, as summarized in Table 1 below were identified by bin number. In each case, the clays were middle Georgia cream clays. As referred to in Table 1, "9" denotes a clay that has a coarse particle size, e.g., about 20 to 60% of the particles below about 2 microns and "6" denotes a clay with a fine particle size, e.g., about 70 to 100% of the particles below about 2 micron.

A measured amount of the crude clay was added to a blunger tank containing measured amounts of water and dispersants. The amount of water was measured to result in a 45 wt. % solids slurry. The dispersants utilized were "N" brand sodium silicate (3.22 $SiO_2/Na_2O$ ratio, 37.6 wt. % active solids) and soda ash; both measured on an active basis. In each example 1.0 ppt (pound 'active' per ton dry clay) soda ash was used. The silicate dosage varied as indicated in Table 1.

The crude clay was blunged with the water and dispersants for about 15 minutes with a high speed Cowles mixer (4,000 feet per minute, fpm, tip speed).

After blunging, the resulting clay slurry was degritted with a 325 mesh screen. The solids content of the degritted slurry was adjusted to about 40.0 wt. % by adding necessary amounts of water. The pH of the dispersed slurry is indicated in Table 1.

After formation of the dispersed clay slurry, the slurry is pre-conditioned. Pre-conditioned for purposes of the present invention is defined as the addition of flotation chemicals to the clay slurry prior to the addition of the collector reagent. (conditioning is defined as the addition of the collector reagent) In all of the examples, the primary purpose of pre-conditioning was the addition of the alkali aluminate compound, which in the given examples was sodium aluminate (Vinings Chemical Co. USA-45 brand, added on an as received basis). In addition to sodium aluminate, caustic (NaOH) was added in some examples to adjust the slurry to a predetermined pH. In a preferred embodiment the sodium aluminate has a low sodium to aluminum ratio of at least 1.26, $Na_2O/Al_2O_3$, molecular ratio.

The sodium aluminate was added without dilution in a measured amount directly to the clay slurry while the slurry was being mixed under a high speed laboratory mixer. A standard sample size of 250 gm of slurry at 40 wt. % solids, 1000 gm dry clay was used in all examples during the pre-conditioning.

Following preconditioning, the clay slurry was prepared for conditioning by adjusting the pH and adding the collector. Caustic (NaOH) was used to raise the pH to a predetermined conditioning pH. This pH was either 8.0 or 9.0, as specified in Table 1. The collector in each example was oleic acid (Nottingham Chemical, TO-1000, food grade, 98% oleic), added at a specified dosage as an emulsion. This emulsion was prepared by mixing the oleic acid, 200 ml. water and caustic (NaOH to conditioning pH) under a slow speed lab mixer.

The oleate emulsion was added to the clay slurry while it was being mixed under a high speed laboratory mixer. Different mixers were used (IKA, Ross, and Kadymill), but the same mixer was used for each sample. The mixer and the conditioning (mixing) time for each sample is indicated in Table 1.

During the conditioning period, the pH of the slurry was continuously monitored. Caustic (NaOH) was added as necessary to maintain the specified pH.

Following conditioning, the clay slurry was floated in a Denver laboratory flotation machine, Model D12 with a 1 gallon cell. Dilution water was added as required to effect proper froth removal. The pH of the floating slurry was continuously monitored and maintained at the indicated flotation pH by the addition of caustic (NaOH). The flotation time varied; flotation was continued until froth generation ceased, in a practical sense, as determined by an experienced operator. Flotation times varied from 30 to 60 minutes as indicated in Table 1. During this time the air flow and shaft speed were gradually increased to maintain good froth production. By the end of flotation, the air flow was about 500 cc/min and the shaft speed was about 1800 rpm (2¾" diameter impeller).

For evaluation purposes the samples were flocculated with alum, filtered, dried in a microwave oven and pulverized with a Mouli Varco Model 228 Dry Grinder in preparation for analysis. The brightness and yellowness index of the samples were measured with a Technidyne Technibrite Micro TB-1C using TAPPI standards and procedures. The titanium and iron analysis were measured with a Phillips Model PW 1404 X-ray Fluorescence Analyzer.

TABLE 1

| Example | 1 | 2 | 3 | 4 | 5 |
|---|---|---|---|---|---|
| Clay | 9A1 | 9A2 | 6A | 9B | 6B |
| Silicate Dosage, ppt | 3.0 | 3.0 | 3.5 | 2.25 | 2.5 |
| Dispersed Slurry pH | 6.0 | 6.8 | — | — | 6.8 |
| Pre-conditioning pH | 8.0 | 9.0 | 8.0 | 8.0 | 8.0 |
| Conditioning pH | 8.0 | 9.0 | 8.0 | 8.0 | 8.0 |
| Oleic Acid Dosage, ppt | 6.0 | 3.0 | 6.0 | 6.0 | 6.0 |
| Conditioner Type | Ross | IKA | Kady | Kady | Ross |
| Conditioning Time, Min. | 45 | 50 | 15 | 15 | 60 |
| Flotation pH | 9.0 | 9.0 | 9.0 | 9.0 | 9.0 |

EXAMPLE 1

In this example the effect of aluminate was evaluated by comparing unfloated samples with floated samples that were floated with and without aluminate. In this example the above basic procedure was followed. The pre-conditioning, conditioning, and flotation conditions are listed in Table 1 above. The analyzed properties of the clay are given in Table 2 below.

TABLE 2

| Analysis | Unfloated Control | Floated No Aluminate | Floated ¾ ppt. Aluminate |
|---|---|---|---|
| Brightness | 81.0 | 84.3 | 85.8 |
| Yellowness Index | 10.0 | 8.3 | 7.3 |
| Titanium Wt. % $TiO_2$ | 1.80 | 0.83 | 0.60 |
| Iron wt. % $Fe_2O_3$ | 0.46 | 0.42 | 0.39 |

As can be seen from the data in Table 2, the addition of aluminate as a flotation aid allowed for more complete removal of titanium and iron impurities and thus substantially increased the quality of the resulting clay product.

EXAMPLE 2

In this example the effect of the amount of aluminate utilized was evaluated by varying the amount of aluminate utilized during the pre-conditioning procedure. The pre-conditioning, conditioning and flotation conditions are listed in Table 1 above. The analyzed properties of the clay are given in Table 3 below.

TABLE 3

| Analysis | Unfloated Control | Floated Aluminate Dosage, ppt ½ | ¾ | 1.0 |
|---|---|---|---|---|
| Brightness | 80.7 | 84.7 | 85.2 | 84.6 |
| Yellowness Index | 10.1 | 7.8 | 7.6 | 8.0 |
| Titanium, wt. % $TiO_2$ | 1.81 | 0.85 | 0.72 | 0.92 |
| Iron, wt. % $Fe_2O_3$ | 0.45 | 0.41 | 0.41 | 0.41 |

As can be seen from the data of this example, various treatment levels of aluminate are effective for the removal of impurities and the subsequent improvement of the clay properties. However, there does appear to be optimum levels of treatment that can be utilized to minimize the amount of aluminate utilized while maximizing the purification of the clay.

EXAMPLE 3

Having discovered that there is an optimum aluminate dosage for removing impurities in previous Example 2 above, this example further investigates the sensivity of aluminate dosages by experimentally testing small incremental dosages of aluminate. The pre-conditioning, conditioning, and flotation conditions are listed in Table 1 above. The analyzed properties of the clay are given in Table 4 below.

TABLE 4

| Analysis | Unfloated Control | Floated Aluminate Dosage, ppt 0 | ⅛ | ¼ | ⅜ | ½ | ¾ |
|---|---|---|---|---|---|---|---|
| Brightness | 82.1 | 83.6 | 86.1 | 86.4 | 85.8 | 84.5 | 84.4 |
| Yellowness Index | 7.8 | 6.4 | 5.4 | 5.2 | 5.7 | 6.2 | 6.1 |
| Titanium | 1.72 | — | 0.66 | 0.56 | 0.79 | 1.04 | 1.07 |

TABLE 4-continued

| Analysis | Unfloated Control | Floated Aluminate Dosage, ppt 0 | ⅛ | ¼ | ⅜ | ½ | ¾ |
|---|---|---|---|---|---|---|---|
| wt. % $TiO_2$ | | | | | | | |

From the above data it appears that in the present example there exists an optimum aluminate dosage of between ⅛ and ⅜ ppt of aluminate. Beyond either end of this range the effectiveness of the aluminate decreases.

EXAMPLE 4

Having evaluated various parameters of the invention in the previous examples, this example utilizes a different clay as a starting material. In this example the initial clay has properties as indicated in Table 5 below. The pre-conditioning, conditioning, and flotation conditions are listed in Table 1 above.

TABLE 5

| Analysis | Unfloated Control | Floated Aluminate Dosage, ppt 0 | ⅛ | ¼ | ⅜ | ½ |
|---|---|---|---|---|---|---|
| Brightness | 81.9 | 85.5 | 86.3 | 87.3 | 87.7 | 87.1 |
| Yellowness Index | 8.1 | 6.4 | 5.1 | 4.8 | 3.9 | 4.9 |
| Titanium wt. % $TiO_2$ | 1.67 | 0.61 | 0.57 | 0.51 | 0.31 | 0.48 |

EXAMPLE 5

As in Example 4 above, this example utilizes a different clay as a starting material.

In this example the initial clay has properties as indicated in Table 6 below. The pre-conditioning, conditioning, and flotation conditions are listed in Table 1 above.

TABLE 6

| Analysis | Unfloated Control | Floated Aluminate Dosage, ppt 0 | ⅛ | ¼ | ⅜ | ½ |
|---|---|---|---|---|---|---|
| Brightness | 81.6 | 84.5 | 85.0 | 86.1 | 85.6 | 85.1 |
| Yellowness Index | 7.9 | 6.2 | 6.0 | 5.3 | 5.6 | 6.0 |
| Titanium wt. % $TiO_2$ | 1.65 | 0.95 | 0.89 | 0.70 | 0.85 | 0.95 |

In this example the optimum dosage for the aluminate appears to center around ¼ ppt. In contrast, the optimum aluminate dosage in previous Example 4 appears to center around ⅜ ppt. This difference in results suggests that there is a particular optimum aluminate dosage that is dependent on the particular mineral material. In comparing the above Examples 2–5 it appears that the aluminate dosage is also at least partially dependent on the average particle size of the starting material.

From the above examples it has been shown that use of the flotation aid of the present invention enables the removal of substantially more contaminates or impurities from minerals than conventional flotation procedures which do not utilize the present novel flotation aid. The present invention therefore allows for the production of highly purified mineral products.

I claim:

1. A composition comprising (a) a dispersed water slurry containing clay minerals and contaminants, (b) an alkali metal aluminate being present in an amount of ⅛ pound to ⅜ pound per ton dry weight clay present; (c) oleic acid being present in an amount of 3 pounds to 6 pounds per ton dry weight clay present; and (d) alkali hydroxide being present n an amount sufficient to maintain a pH of 8 to 9 in the water slurry of clay minerals.

2. The composition of claim 1, further comprising a sodium silicate - sodium carbonate dispersing agent, the amount of sodium silicate being 2.25 to 3 pounds per ton dry weight clay mineral present and the amount of sodium carbonate being 1 pound per ton dry weight clay mineral present.

3. The composition of claim 1, wherein the alkali metal aluminate is added first to a dispersed slurry of clay minerals, followed by the oleic acid, the alkali hydroxide added with the alkali metal aluminate, with the oleic acid, or alone as needed to maintain the necessary pH in the dispersed slurry of clay mineral.

4. The composition of claim 1, wherein the alkali metal aluminate contains a cation selected from the group consisting of ammonium and alkali metals.

5. The composition of claim 1, wherein the alkali metal aluminate is sodium aluminate.

6. The composition of claim 5, wherein the sodium aluminate has a $Na_2O$ to $Al_2O_3$ ratio of at least 1.26.

7. A composition comprising (a) a dispersed water slurry of kaolin and contaminants; (b) sodium aluminate being present in an amount of ⅛ pound to ⅜ pound per ton dry weight kaolin; (c) oleic acid being present in an amount of 3 pounds to 6 pounds per ton dry weight kaolin; and (d) sodium hydroxide being present in an amount sufficient to maintain a pH of 8 to 9 in the kaolin slurry.

8. A composition of claim 7, further comprising a sodium silicate-sodium carbonate dispersing agent, the amount of sodium silicate being 2.25 to 3 pounds per ton dry weight kaolin and the amount of sodium carbonate being 1 pound per ton dry weight kaolin.

9. The composition of claim 7, wherein the sodium aluminate is added first to the dispersed slurry of kaolin, followed by the oleic acid and the sodium hydroxide is added with the sodium aluminate, with the oleic acid or alone as needed to maintain the necessary pH in the dispersed slurry of kaolin.

10. The composition of claim 8, wherein the sodium silicate - sodium carbonate dispersing agent is added before the sodium aluminate.

11. The composition of claim 7, wherein the sodium aluminate has a $Na_2O/Al_2O_3$ ratio of at least 1.26.

12. The composition of claim 8, wherein the sodium aluminate has a $Na_2O/Al_2O_3$ ratio of at least 1.26.

* * * * *